US006955445B2

(12) United States Patent
Omowale

(10) Patent No.: US 6,955,445 B2
(45) Date of Patent: Oct. 18, 2005

(54) ILLUMINATED WRITING IMPLEMENT

(76) Inventor: Djoser Omowale, 120 Bellamy Loop, No. 22A, Bronx, NY (US) 10475

( * ) Notice: Subject to any disclaimer, the term of this patent is extended or adjusted under 35 U.S.C. 154(b) by 41 days.

(21) Appl. No.: 10/763,312

(22) Filed: Jan. 23, 2004

(65) Prior Publication Data

US 2005/0162846 A1 Jul. 28, 2005

(51) Int. Cl.[7] ..... B43K 29/10
(52) U.S. Cl. ..... 362/118; 362/109; 362/205
(58) Field of Search ..... 362/118–120, 253, 362/205; 401/195, 52, 192

(56) References Cited

U.S. PATENT DOCUMENTS

| | | | | |
|---|---|---|---|---|
| 1,538,055 A | | 5/1925 | Olsen | 362/118 |
| 4,037,343 A | | 7/1977 | Lonsmin | 40/334 |
| 4,466,742 A | * | 8/1984 | Lemelson | 368/10 |
| 4,585,364 A | * | 4/1986 | Liaw | 401/195 |
| 5,475,575 A | * | 12/1995 | Chin-Hsiang | 362/203 |
| 5,730,539 A | * | 3/1998 | Chabria | 401/195 |
| 6,164,856 A | | 12/2000 | Lo | 401/52 |
| 6,299,372 B1 | | 10/2001 | Wang | 401/195 |
| 6,719,473 B1 | * | 4/2004 | Kao | 401/195 |

* cited by examiner

*Primary Examiner*—Ali Alavi
(74) *Attorney, Agent, or Firm*—Collard & Roe, P.C.

(57) ABSTRACT

An illuminated writing implement has substantially tubular body and head portions. An electrically connected power source and light source are located in an interior of the head portion. A removable cap is provided on the top of the head portion. A display unit for displaying the time and date is located on an outer surface of the head portion. Switches are used to set the illumination mode of the light source and the time and date shown by the display unit. A beam of light produced by the light source shines through a lens at the bottom of the writing implement. A marking element has a tip which protrudes through a hole in the lens for writing or drawing. The brightness and focus of the beam of light are adjusted by rotating the head portion and a focusing ring on the body portion of the writing implement.

13 Claims, 2 Drawing Sheets

ILLUMINATED WRITING IMPLEMENT

BACKGROUND OF THE INVENTION

1. Field of the Invention

This invention generally relates to writing implements and in particular relates to pens or pencils having a self-contained adjustable illumination means.

2. The Prior Art

U.S. Pat. No. 1,538,055 to Olsen discloses a combined pencil, pen and flashlight device. U.S. Pat. No. 4,037,343 to Lonsmin discloses a writing instrument including means for having a person's name appear and disappear according to the orientation of the writing instrument. U.S. Pat. No. 6,164,856 to Lo discloses a pen having a self-contained means for illuminating a region in proximity to the pen tip as well as printed information provided on the body of the pen. U.S. Pat. No. 6,299,372 to Wang discloses a pen having a means for illuminating a surface of the pen which is provided with an advertisement.

SUMMARY OF THE INVENTION

It is an object of this invention to provide a writing implement having an integral light source. It is another object of this invention to provide a writing implement with an integral light source and a means for displaying the date and time. It is another object of this invention to provide a writing implement with an integral light source which may be activated by applying pressure to a point of the implement when writing, thereby illuminating a surface which is being written upon. It is yet another object of this invention to provide a writing implement having an integral light source wherein the intensity and focus of the illumination are easily adjustable by a user of the writing implement.

These and other objects of the invention are accomplished by providing an illuminated writing implement comprising a substantially tubular body portion with a substantially tubular head portion rotatably secured thereto, a cap detachably secured to a top of the head portion, a power source disposed in an interior of the head portion, a light source electrically coupled to the power source and disposed in an interior of the head portion, a display unit disposed on an outer surface of the head portion for displaying a time and date, a switch electrically coupled to the power source for setting a mode of operation of the light source, a switch electrically coupled to the display unit for setting a time and date to be displayed, a focusing ring rotatably secured to the body portion, a substantially conically-shaped lens disposed at a lower end of the body portion, and a marking element disposed in an interior of the illuminated writing implement with a tip which protrudes through an opening in the lens, wherein the light source produces a beam of visible light which is transmitted through the lens, and wherein rotating the focusing ring narrows and broadens the beam of light and rotating the head portion with respect to the body adjusts the brightness of the beam of light.

The illuminated writing implement preferably includes a substantially tubular cover detachably secured to and covering the body portion, lens and tip. A beam of light is transmitted through a window disposed at a bottom end of the cover. A message is preferably provided on an outer surface of the body and cover.

In a preferred embodiment, the light source provides light only when pressure is applied to the tip of the writing implement.

The marking element preferably comprises a pen refill insert or a pencil refill insert having a plurality of pencil point units and a spring for providing a force on the insert such that a lowest pencil point unit protrudes through the lens. At least one eraser head is preferably disposed on top of the marking element.

A clip is preferably disposed on an outer surface of the head portion of the illuminated writing implement and may have a graphic image disposed thereon.

In a preferred embodiment the display unit is illuminated and may comprise a liquid crystal display.

The light source is preferably an incandescent bulb or a light emitting diode (LED). The power source is preferably a battery.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
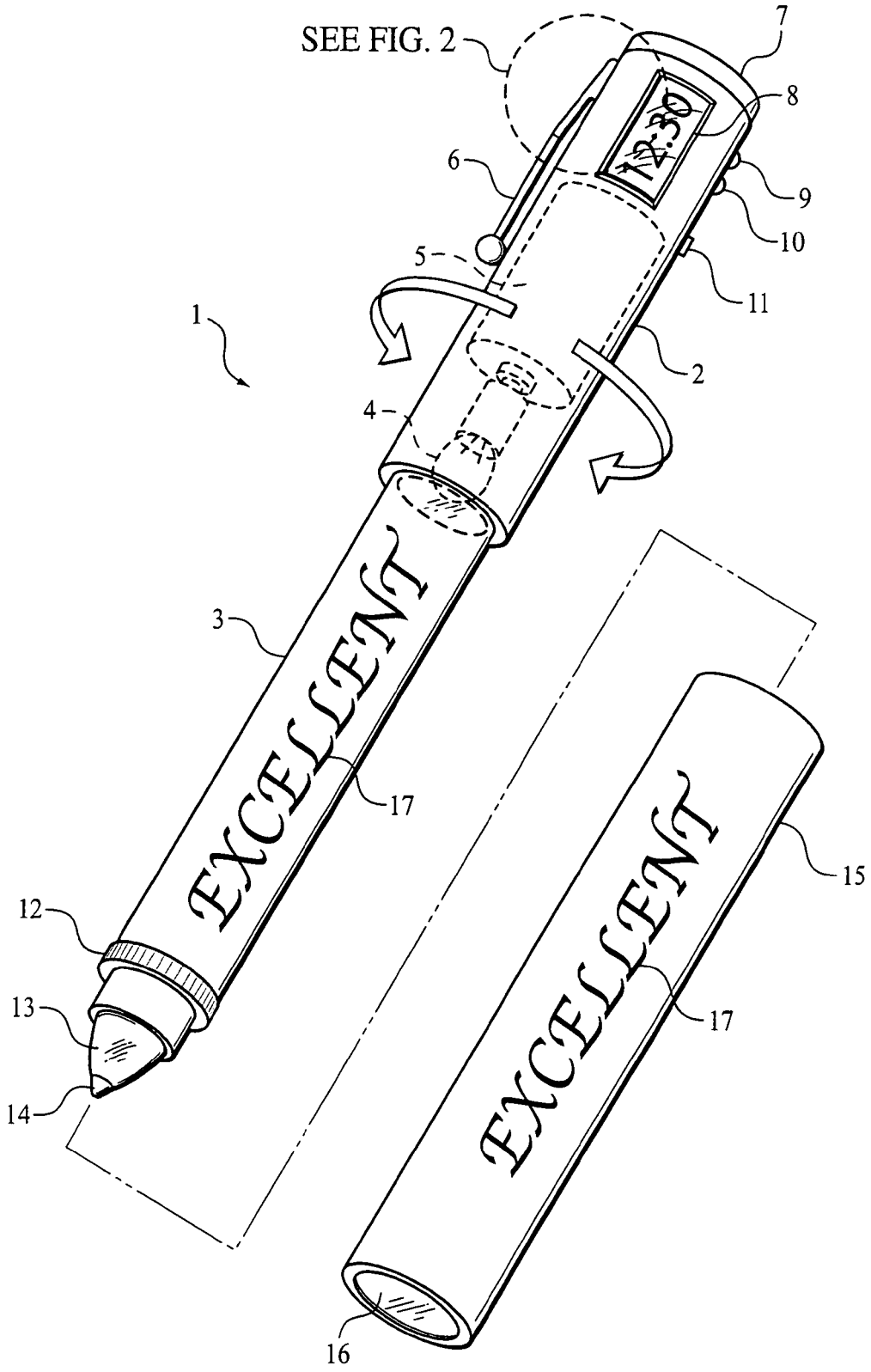
FIG. 1 shows a perspective view of an illuminated writing implement along with a cover for an illuminated writing implement.

Referring now in detail to the drawings and, in particular, FIG. 1, an illuminated writing implement 1 is shown having an upper head portion 2 and a lower body portion 3. Head portion 2 and body portion 3 are made of a rigid, opaque material, such as plastic or metal, and are substantially tubular in shape. An interior of head portion 2 and body portion 3 is hollow to accommodate the various components disposed therein.

A light source 4 is disposed within illuminated writing implement 1, preferably within head portion 2. Light source 4 may comprise, for example an incandescent light bulb or a light emitting diode. Light source 4 is electrically coupled to a power source 5, which may comprise a battery or photocell and provides energy for illuminating light source 4.

Clip 6 which is disposed on an outer surface of head portion 2 may be used to secure illuminated writing implement 1 to a user's pocket, pocket protector or the like.

A removable cap 7 is detachably secured to a top of head portion 2. Cap 7 may be removed to provide access to power source 5 and light source 4 for repair or replacement of same. Cap 7 may be, for example, threaded so that it may be easily secured to and removed from head portion 2.

A display unit 8 capable of displaying a time and date is disposed on an outer surface of head portion 2. Display unit 8 may be powered by power source 5 and may be illuminated independently of light source 4. Display unit 8 may comprise, for example, a liquid crystal display.

Switches 9, 10, 11 which are coupled to power source 5 and/or display unit 8 are located on head portion 2. Switches 9, 10, 11 may comprise, for example, push button or sliding switches. Switch 9 which is coupled to display unit 8 may be used to set a current time and date and an alarm time. Switch 10 which is also coupled to display unit 8 may be used to select an alarm mode or to illuminate display unit 8. Switch 11 which is coupled to power source 5 may be used to select a mode of operation for light source 4. Switch 11 may be used to select an "on" mode wherein light source 4 is illuminated, an "off" mode wherein light source 4 is not illuminated or an "automatic" mode wherein light source 4 is illuminated only when a pressure is applied to a point 14 of illuminated writing implement 1, for example when a user is using it to write or draw.

Head portion 2 of illuminated writing implement 1 may be rotated with respect to body portion 3 in the manner shown by the arrows in FIG. 1 in order to adjust the intensity or degree of brightness of light source 4. For example, rotating head portion 2 clockwise may brighten the illumination provided by light source 4 and rotating head portion 2 counter-clockwise may dim the illumination provided by light source 4, or vice-versa.

Focusing ring 12 may be provided at a lower section of body portion 3. Focusing ring 12 is rotated clockwise and counter-clockwise to adjust an illumination focus by alternatively narrowing or broadening a beam of light provided by light source 4.

A transparent or semi-transparent lens 13 is provided at a bottom end-of body portion 3. Transparent lens 13 may be generally conical in shape and has a hole located at its point so that a tip 14 of a marking element, such as a pen or pencil point, may protrude through transparent lens 13. Light provided by light source 4 shines through transparent lens 13.

Also shown in FIG. 1 is cover 15 comprising a rigid, hollow cylindrical element which is dimensioned to fit over body portion 3. Cover 15 is open at a top end and closed at a bottom end and is detachably secured to body portion 3 such that pen or pencil point 14 is not exposed when illuminated writing implement is not being used to write or draw.

Additionally, cover 15 may have a transparent or semi-transparent window 16 disposed at its bottom end. Light from light source 4 may shine through lens 13 and window 16 when cover 15 is secured to illuminated writing implement 1. In this way, illuminated writing implement 1 may be used in the manner of an ordinary flashlight.

As shown in FIG. 1, a message or word of prestige 17 may be provided on either or both of body portion 3 and cover 15. Message or word of prestige 17 may be applied to body portion 3 or cover 15 by, for example, screen printing, embossing or any conventional means for applying text to a rigid body. Word of prestige 17 may be written in a stylized text such as a style simulating calligraphy. Additionally various words of prestige 17 may provided on different illuminated writing implements 1, each word beginning with a different letter of the alphabet, from A to Z.

Figure 2:
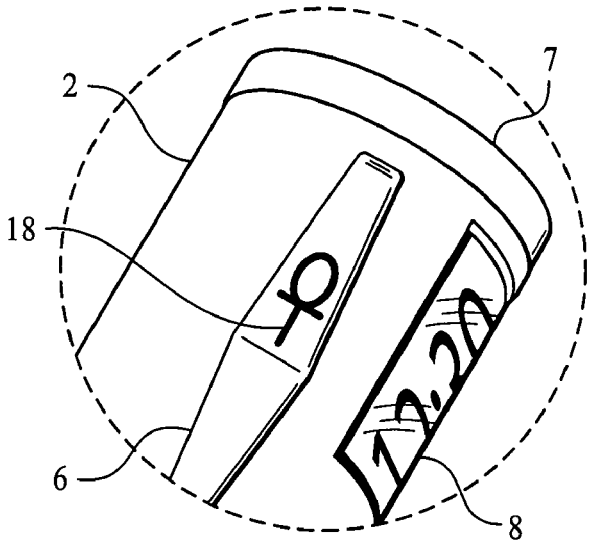
FIG. 2 shows a magnified view of an upper portion of an illuminated writing implement as shown in FIG. 1.

FIG. 2 shows an enlarged view of an area near a top portion of head portion 2. As shown, clip 6 may be provided with text or a graphic image 18. Text or graphic image 18 may be applied to clip 6 by, for example, screen printing, embossing or any conventional means for applying text to a rigid body. As shown in FIG. 2, image 18 comprises an Ankh, an African symbol for family, fertility and prosperity.

Figure 3:
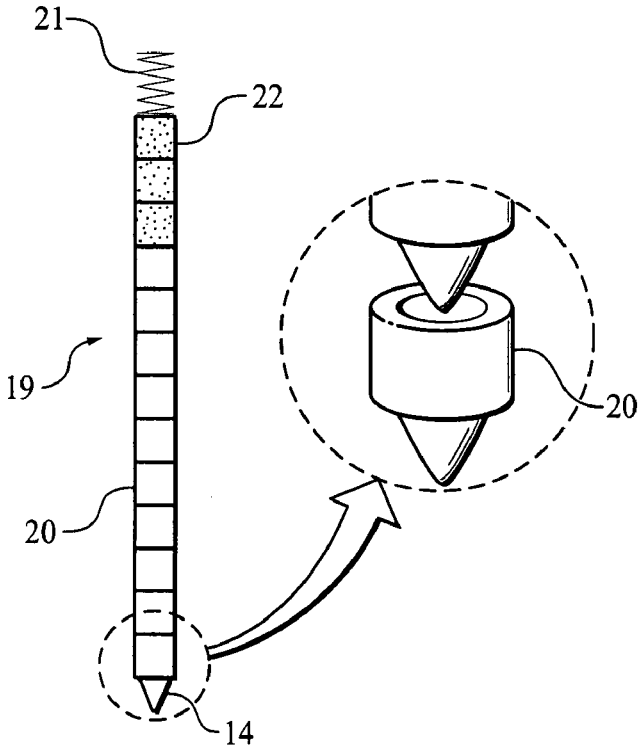
FIG. 3 shows a pencil refill insert for an illuminated writing implement.

FIG. 3 shows a marking element comprising a pencil refill insert 19 for an illuminated writing implement. Pencil refill insert 19 may be comprised of individual pencil point units 20. For example, pencil refill insert 19 may include 10-12 individual pencil point units 20. As shown in the enlarged detailed portion of FIG. 2, individual pencil point units 20 may have a hollowed out top portion such that adjoining pencil point units may fit together in a stacked manner. When a point of individual pencil point units 20 wears down, that unit is removed and a pencil point unit 20 which was immediately behind that unit replaces the worn point. Spring 21 provided a force to push individual pencil point units 20 toward a tip of illuminated writing implement 1 such that a point of a lowest individual pencil point unit 20 protrudes through lens 13.

Figure 4:
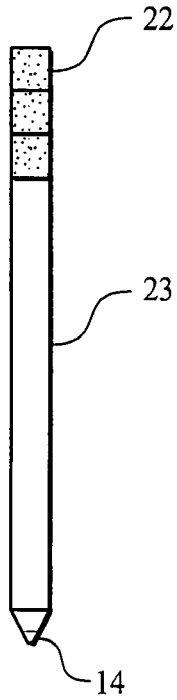
FIG. 4 shows a pen refill insert for an illuminated writing implement.

FIG. 4 shows a marking element comprising a pen refill insert 23 for an illuminated writing implement. As with pencil refill insert 19, a tip of pen refill insert 23 protrudes thorough lens 13 for writing. Pencil refill insert 19 or pen refill insert 23 is removably secured to an interior portion of illuminated writing implement 1, preferably in body portion 3. Removable eraser head 22 may be disposed at a top portion of pencil refill insert 19 or pen refill insert 23. Each pencil or pen refill insert may for example, include three removable eraser heads.

Accordingly, while several embodiments of the present invention have been shown and described, it is obvious that many changes and modifications may be made thereunto without departing from the spirit and scope of the invention.

What is claimed is:

1. An illuminated writing implement comprising:

(a) a substantially tubular body portion;

(b) a substantially tubular head portion rotatably secured to said body portion;

(c) a cap detachably secured to a top of said head portion;

(d) a power source disposed in an interior of said head portion;

(e) a light source disposed in an interior of said head portion and electrically coupled to said power source;

(f) a display unit for displaying a time and date disposed on an outer surface of said head portion;

(g) a switch electrically coupled to said power source for setting a mode of operation of said light source;

(h) a switch electrically coupled to said display unit for setting a time and date to be displayed;

(i) a focusing ring rotatably secured to said body portion;

(j) a substantially conically-shaped lens disposed at a lower end of said body portion; and (k) a marking element disposed in an interior of the illuminated writing implement, said marking element having a tip which protrudes through an opening provided in said lens;

wherein said light source produces a beam of visible light only when a pressure is applied to said tip, said beam of visible light being transmitted through said lens, wherein rotating said focusing ring narrows and broadens said beam of light and wherein rotating said head portion with respect to said body portion adjusts a brightness of said beam of light.

2. The illuminated writing implement according to claim 1, further comprising a substantially tubular cover detachably secured to and covering said body portion, said lens and said tip, said cover having a window disposed at a bottom end thereof, wherein said beam of light is transmitted through said window.

3. The illuminated writing implement according to claim 2, further comprising a message disposed on an outer surface of said body and on an outer surface of said cover.

4. The illuminated writing implement of claim 1, wherein said power source comprises a battery.

5. The illuminated writing implement according to claim 1, wherein said marking element comprises a pencil refill insert comprising a plurality of pencil point units and a spring, wherein said spring provides a force on said pencil refill insert such a point of a lowest individual pencil point unit protrudes through said lens.

6. The illuminated writing implement according to claim 1, wherein said marking element comprises a pen refill insert.

7. The illuminated writing implement according to claim 1, further comprising at least one eraser head disposed on top of said marking element.

8. The illuminated writing implement according to claim 1, further comprising a clip disposed on an outer surface of said head portion.

9. The illuminated writing implement of claim 8, further comprising a graphic image disposed on an outer surface of said clip.

10. The illuminated writing implement of claim 1, wherein said display unit may be illuminated.

11. The illuminated writing implement of claim 1, wherein said display unit comprises a liquid crystal display.

12. The illuminated writing implement of claim 1, wherein said light source comprises an incandescent light bulb.

13. The illuminated writing implement of claim 1, wherein said light source comprises a light emitting diode.

* * * * *